United States Patent [19]

Rodi et al.

[11] Patent Number: 4,832,329

[45] Date of Patent: May 23, 1989

[54] DEVICE FOR CONTROLLING A PILE LIFTING DEVICE AND METHOD OF OPERATION

[75] Inventors: Anton Rodi, Leimen; Michael Krüger, Edingen-Neckarhausen, both of Fed. Rep. of Germany

[73] Assignee: Heidelberger Druckmaschinen AG, Heidelberg, Fed. Rep. of Germany

[21] Appl. No.: 97,603

[22] Filed: Sep. 16, 1987

[30] Foreign Application Priority Data

Sep. 16, 1986 [DE] Fed. Rep. of Germany ..... 3631456

[51] Int. Cl.[4] ..... B65H 1/18

[52] U.S. Cl. ..... 271/155

[58] Field of Search ..... 271/148, 154, 155, 31; 377/8

[56] References Cited

U.S. PATENT DOCUMENTS

| | | | |
|---|---|---|---|
| 2,912,243 | 11/1959 | Gulick | 271/153 |
| 3,716,226 | 2/1973 | Kistner | 271/31 |
| 3,768,806 | 10/1973 | Reehil | 271/155 |
| 4,310,153 | 1/1982 | Kikuchi | 271/111 X |
| 4,535,463 | 8/1985 | Ito | 271/155 X |
| 4,624,454 | 11/1986 | Grutzmacher | 271/153 |

FOREIGN PATENT DOCUMENTS

| | | |
|---|---|---|
| 1181717 | 7/1965 | Fed. Rep. of Germany . |
| 158171 | 1/1983 | Fed. Rep. of Germany . |

OTHER PUBLICATIONS

Hall-Magnetgabelschranke Hkz-101; pp. 3-9.

Elektronische Lastrelais (ELR)—Wirkungsweise und praktischer (Brünnler) Einsatz—Siemens Components 20 (1982) vol. 3, pp. 83-87.

*Primary Examiner*—Richard A. Schacher

*Attorney, Agent, or Firm*—Herbert L. Lerner; Laurence A. Greenberg

[57] ABSTRACT

Device for controlling a pile-lifting device of a sheet-processing machine has a drive for performing correction movements in order to keep the upper side of the pile within a range of heights, a device for scanning the position of an upper side of the pile so as to determine whether the upper side of the pile has reached a predetermined height or not, and a control device for controlling the correction movements in accordance with the result of the scanning of the position of the upper side of the pile, and includes device for determining a quantity dependent upon the correction movement.

22 Claims, 3 Drawing Sheets

24
20
26
22
14
32
31
M
2
16
4
33
30
8
10
12
6
2
1
3
34

Fig. 2
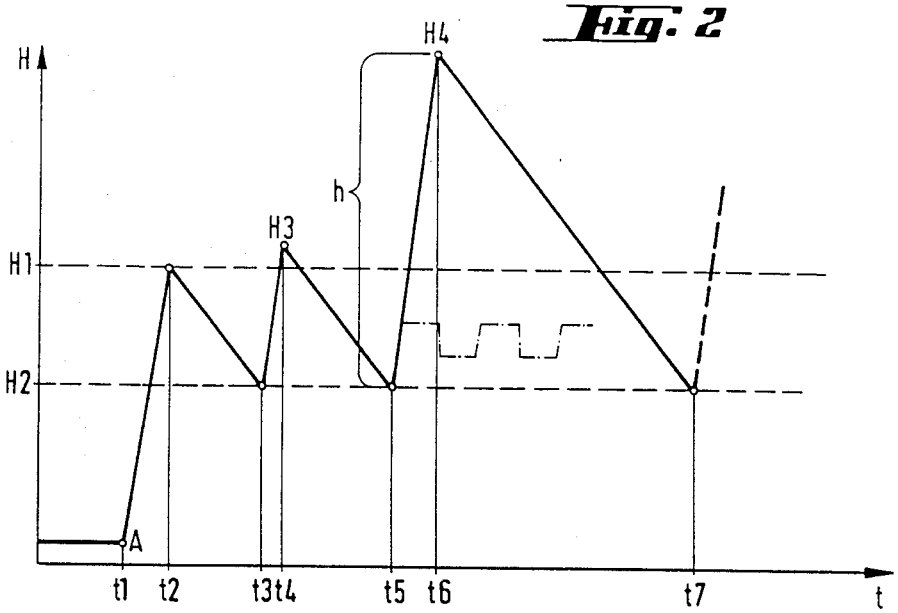
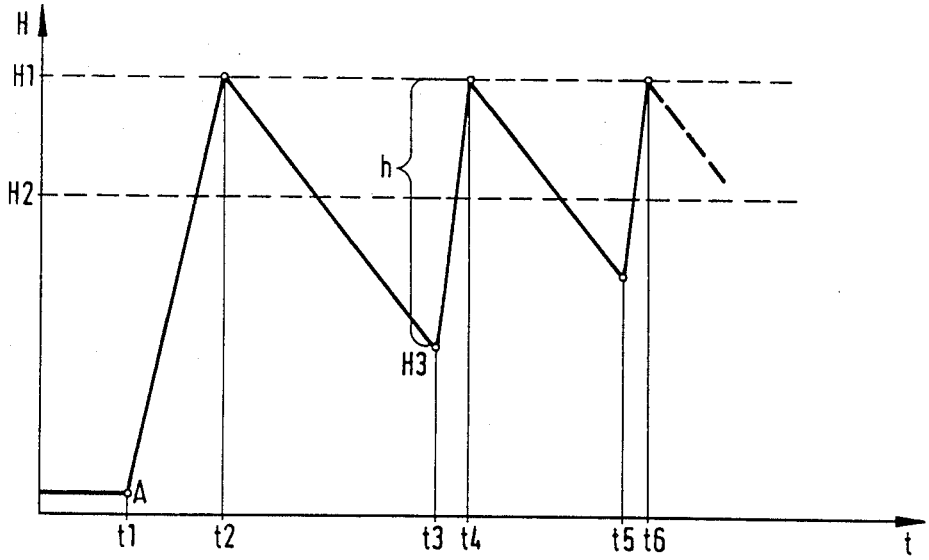
Fig. 3

DEVICE FOR CONTROLLING A PILE LIFTING DEVICE AND METHOD OF OPERATION

The invention relates to a device for controlling a pile-lifting device of a sheet-processing machine having a drive for performing correction movements in order to keep an upper side of the pile within a range of heights, a device for scanning the position of the upper side of the pile so as to determine whether the upper side of the pile has reached a predetermined height or not, and a control device for controlling the correction movements in accordance with the result of the scanning of the position of the upper side of the pile.

In such a control for a sheet feeder heretofore known from German Democratic Republic Pat. No. 158 171, the state of a forward-backward counter is controlled as a function of the time intervals at which a scanner determines that the upper side of the pile is not reaching the desired height, the forward-backward counter activating one of a plurality of timing elements, as a result of which a drive motor is switched on for the time determined by the respective timing element. With this heretofore known control method, the magnitude of the travel of the pile is realized by different operating times of the motor, depending upon the quantity of paper processed. A disadvantage of this conventional method is that the magnitude of the correction movement is not directly dependent upon the paper thickness, and that the paper thickness cannot be determined. A further disadvantage is in the fact that, due to the time control, it is not possible to take parameters such as temperature, voltage, ageing, etc. into account.

It is accordingly an object of the invention to provide a device of the foregoing general type which affords expended possibilities for controlling the correcting movement of the sheet pile.

With the foregoing and other objects in view, there is provided, in accordance with the invention, a device for controlling a pile-lifting device of a sheet-processing machine having a drive for performing correction movements in order to keep the upper side of the pile within a range of heights, a device for scanning the position of an upper side of the pile so as to determine whether the upper side of the pile has reached a predetermined height or not, and a control device for controlling the correction movements in accordance with the result of the scanning of the position of the upper side of the pile, comprising means for determining a quantity dependent upon the correction movement.

An advantage of the invention is that the magnitude of the correction movements executed by the pile-lifting device can be defined more accurately, because a value dependent upon the correction movement is determined, such as the rotational angle of the motor driving the pile-lifting device, for example. Consequently, deviations of the actual correction movement from the correction movement preset by the control apparatus, such as of the type which may occur, for example, due to stiffness in the drive of the pile-lifting device or due to wear on a brake, can be determined and taken into account in presetting the next correction movement. This also permits rapid optimal matching of the correction movements to the sheet thickness. The invention is applicable both for devices which lift a pile and devices which lower a pile.

In accordance with another feature of the invention, there are included means for producing information regarding operating speed of the machine (particularly the cycle rate=sheet rate).

An advantage thereof is that this construction provides the possibility of automatically determining the sheet thickness, when considered in conjunction with the known magnitude or value of the previously executed correction movement. It also provides the possibility of determining, in a relatively simple manner, whether and, if applicable, how many sheets are removed and fed in, respectively, during a correction movement.

In accordance with a further feature of the invention, a memory is provided wherein setpoint values for the correction movement as a function of sheet thickness are storable. An advantage thereof is that the possibility is then afforded, for example, for the correction movement belonging to a specific sheet thickness to be indicated or displayed to the operator, with the result that the operator then sets this optimum correction movement in the form of a manual input.

In accordance with an added feature of the invention, however, the control device is of such construction that, depending upon sheet thickness, the control device enables a performance of a correction movement having a magnitude corresponding to a value assigned to the sheet thickness and contained in the memory. In this case, therefore, the correction movement is set automatically by the device.

In particular cases according to the invention, it may be advantageous, before the commencement of work, to input manually a value for the sheet thickness into the machine processing the sheets, and this value can then be corrected automatically by the device according to the invention. It is also possible to take, as an initial value for the sheet thickness, that value which results from the known difference in the height of the pile when the response height or upper limit of a switching element is exceeded and when the response threshold or lower limit of the switching element has been passed in downward direction, together with the information on the number of sheets removed.

In accordance with an additional feature of the invention, there are provided means for producing information on operating speed of the machine, means for producing information on the magnitude of an executed correction movement, and means for determining sheet thickness from the information from both of the information producing means. If the information on the magnitude of the executed correction movement is available in the form of the rotational angle of the drive motor of the pile-lifting device, the information will then contain, via the magnitude of the correction movement, the reduction ratio of a gear unit or transmission downstream of the motor.

In accordance with yet another feature of the invention, the control device is constructed so that a starting frequency of the drive is within a prescribed range. With this construction, the control device increases the magnitude of the correction movement whenever the starting frequency, measured with reference to the aforementioned range, is too high, and reduces the correction movement if the starting frequency is too low. The loadability of the drive of the pile-lifting device can thereby be taken into account.

In case there should be no information available with regard to the cycle rate of the machine processing the sheets, the control device may contain at least one timing element which may be adjustable or, alternatively, the times are realized by a digital data-processing device contained in the control device, the data-processing device being usable also for time measurements. If there should be no information on the cycle rate of the machine processing the sheets, then, upon the realization of the last-described construction, there is, nevertheless, information on the quantity of paper delivered per unit time (magnitude of the correction movement multiplied by the starting frequency).

In accordance with alternate features of the invention, the magnitude of the correction movement is greater than one sheet thickness and may, in particular, correspond at least approximately to a multiple of one sheet thickness. This results in a relatively low starting frequency of the drive. The magnitude of the correction movement may correspond also to one single sheet thickness, in which case the starting frequency is higher. The magnitude of the correction movement may also be smaller than one sheet thickness. If the time interval between consecutive correction movements approaches very low values, the correction movement approaches a continuous correction movement; a continuous correction movement is likewise taken into consideration in accordance with the invention. This eliminates mechanical and, especially, thermal loading of the drive due to a starting frequency that is too high for the drive.

Also, with a continuous correction movement, the device for determining a quantity dependent upon the correction movement continuously determines the quantity. With continuous correction movement, the aforementioned quantity or value may preferably be the correction speed.

In accordance with another feature of the invention, the control device is so constructed that, depending upon the determination of a value, the control device switches the correction movement over. It is especially possible, when, in the time sequence described hereinafter with reference to FIG. 2, the paper thickness is known shortly after the instant of time t5, to switch over to a smaller correction movement than the correction movement provided when the machine is initially switched on (as described with respect to the mode of the method) or to switch to a continuous correction movement.

Generally speaking, given a constant working speed of the sheet-processing machine and assuming a largely constant paper thickness, the pile-lifting device must supply to the machine and remove from the machine, respectively, a predetermined quantity of paper on average per unit time (measured as the total thickness of the sheets supplied or removed). Therefore, the quantity of paper to be delivered by the pile-lifting device on average per unit time can be prescribed as the controlled variable, as is provided for in an embodiment of the invention. In this case, the control device can be so constructed as to select the correction movement and/or the starting frequency so that the required quantity of paper is delivered.

In accordance with a further feature of the invention, there are provided means for detecting movement continued by the pile-lifting device at the end of a correction movement after the drive has been switched off and means for determining an actually performed correction movement from a continued movement detected by the detecting means. This affords a particularly precise determination of the actually executed correction movement. It is also possible, when selecting the correction movement to be performed, to take into account any subsequent running-on of the motor after it has been switched off. The last-described construction affords an accurate method of operation of the device and of the connected pile lifting device, irrespective of any manifestations of wear on a brake which stops the motor after a correction movement has been performed.

In accordance with a concomitant feature of the invention, the control device comprises an arrangement for controlling or varying the speed of the correction movement. This construction is realized particularly easily in drives having a speed which can be easily controlled, for example, when using a d.c. motor. Such a variation in speed can adapt the operation of the entire control device for the pile-lifting device even better to the respective requirements.

It is advantageous, if the device scanning the upper side of the pile has hysteresis, for evaluating only one predetermined edge of the output signal of the scanning device, as is provided for in a construction of the invention.

In accordance with another aspect of the invention, there is provided a method of operating a device for controlling a pile-lifting device of a sheet-processing machine by performing a correction movement in order to keep an upper side of a pile within a range of heights, scanning the position of the upper side of the pile so as to determine whether the upper side of the pile has reached a predetermined height or not, and controlling the correction movement in accordance with the result of the scanning of the position of the upper side of the pile, which includes determining a quantity dependent upon the correction movement.

The invention can be used especially in a pile-lifting device for a feed pile or delivery pile of a printing press.

Other features which are considered as characteristic for the invention are set forth in the appended claims.

Although the invention is illustrated and described herein as embodied in a device for controlling a pile-lifting device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages, thereof will be best understood from the following description of specific embodiments when read in connection with the accompanying drawings, in which:

FIG. 2 is a plot diagram of the height of a sheet pile with respect to time generally representing a first mode of the control method and, in part, more precisely representing another mode of the control method practiced with the device of FIG. 1;

FIG. 3 is another plot diagram like that of FIG. 2 wherein there is a simplified representation of a third mode of the control method.

Figure 1:
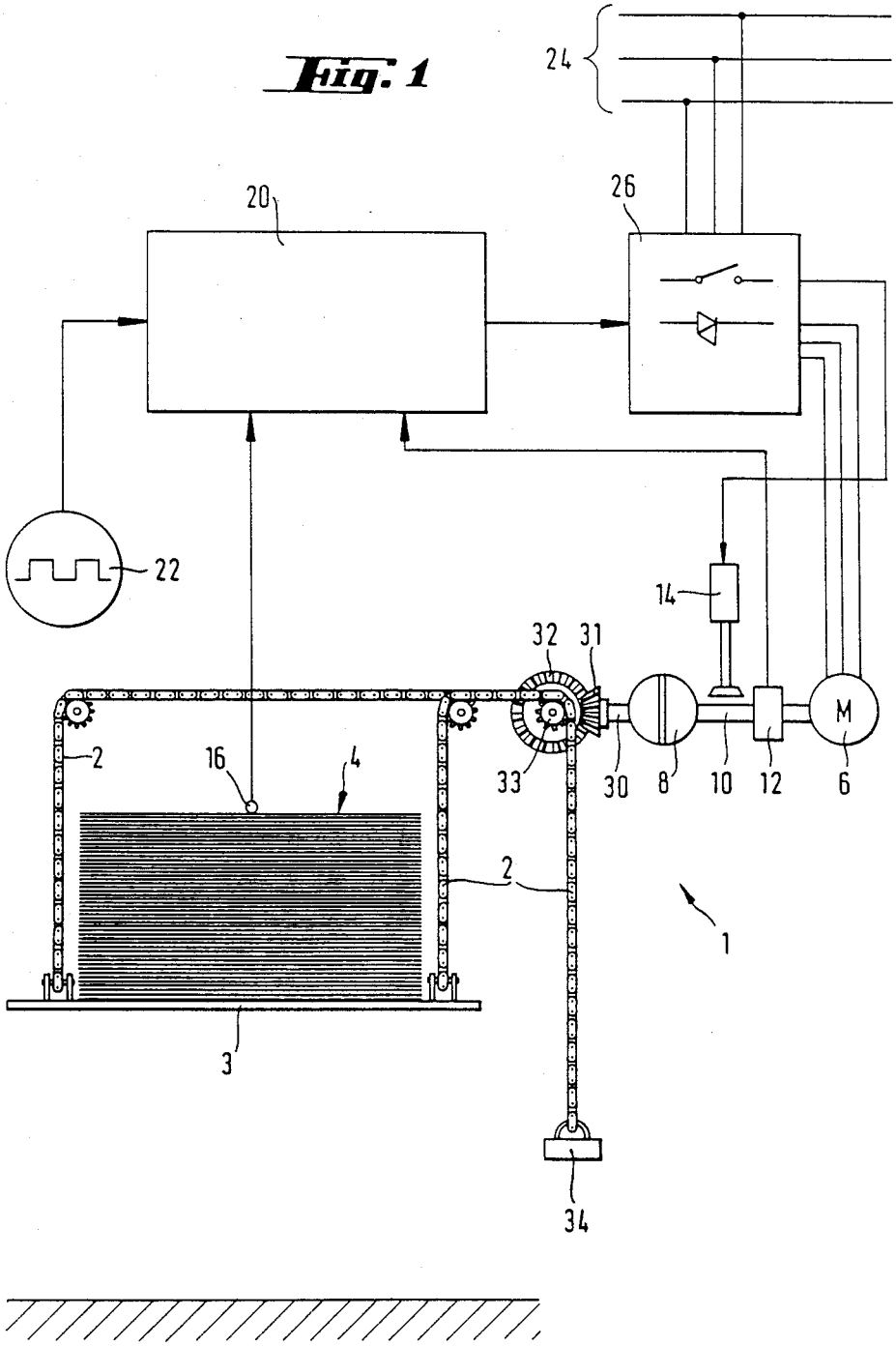
FIG. 1 is a diagrammatic and schematic view of an embodiment of a device for controlling a pile of sheets in accordance with the invention.

Referring now to the drawing and first, particularly, to FIG. 1 thereof, there is shown a pile device 1 having several chains 2 from which a table 3 is suspended. A pile 4 of paper sheets is disposed on the table 3. The chains 2 can be driven by a motor 6, in the form of a 3-phase motor, through the intermediary of a gear unit or transmission 8 connected to a shaft 10 of the motor 6. If necessary, a different motor may be used, e.g. a d.c. motor. The output of the transmission 8 is formed by a further shaft 30 which, via bevel gears 31 and 32, drives sprockets 33 (only one of which is shown) which are in engagement with the chains 2. Weights 34 (only one of which is shown) at the free ends of the chains 2 keep the latter taut. Also mounted on the shaft 10 of the motor 6 is a pulse generator 12 which produces a predetermined number of pulses for each shaft revolution, so that the rotational angle of the shaft 10 can be determined therefrom. An electromechanical brake 14 actuatable via a nm-illustrated transistor makes it possible for the motor 6 to be stopped quickly after it has been switched off electrically. A sensor 16 mounted on the pile device 1 and, in the illustrated embodiment, constructed as a mechanical scanner, serves to supply an electrical signal when, as the table 3 is lifted, the upper side of the pile 4 exceeds a predetermined height or level (switch-on threshold of the sensor). Such a scanning sensor 16 is well known in the art such as is known from German Pat. No. 1 181 717 and may be of the capacitive type as manufactured by the firm Weitmann and Konrad GmbH & Co. KG, of Leinfelden-Echterdingen, Germany. When sheets are removed from the pile 4, subsequently, the sensor 16 does not supply a signal to indicate the lowering of the upper side of the pile 4 until the upper side of the pile has descended, for example, a distance of 0.5 mm (switch-off threshold). The difference in the levels of the switch-on threshold and the switch off threshold is due to hysteresis of the sensor 16. The sensor 16 is so constructed that the pile 4 can continue to be lifted even after the switch-on threshold has been exceeded.

The sensor may also be constructed as a contactless sensor, e.g. an optical reflex switch or capacitive scanning head.

Should the existence of hysteresis be disruptive or should the hysteresis of a given sensor be excessive, it is possible to use sensors of other constructions in which the effect of hysteresis is eliminated by the fact that the sensors scan the upper side of the sheet in time with the machine and are lifted in each cycle so that the pile-height drops below the switch-off threshold of the appertaining sensor; the arrangement is such, for example, that merely the signal corresponding to the switch-on threshold is evaluated.

The output signals of the pulse generator 12 and the sensor 16 are fed to a control circuit 20. In addition, a signal, for example a clock signal characteristic of the operating speed of a machine processing the sheets of the pile 4, such as a sheet-fed offset printing press, is also fed to the control circuit 20. A clock generator 22 connected to the printing press and supplying the signal is shown symbolically.

The control circuit 20 is connected to a power section 26 which is, in turn, connected to a 3-phase power-supply cable 24. Depending upon how it is energized by the control circuit 20, the power section 26 either enables the motor 6 to run and lift the pile 4, with the brake 14 released, or prevents the motor 6 from receiving power and causes the brake 14 to stop rotation of the shaft 10 and the motor 6 and keeps it stopped. The control circuit 20 is also capable of making the motor 6 run in the opposite direction, if required, in order to permit the table 3 to be lowered.

It is also possible for the motor 6 to be braked electrically and for the mechanical brake 14 to be activated only in cases of emergency, e.g. if there is a power failure. It is also possible for a self-locking gear unit, e.g. a worm gear unit, to be used as a brake.

Figure 4:
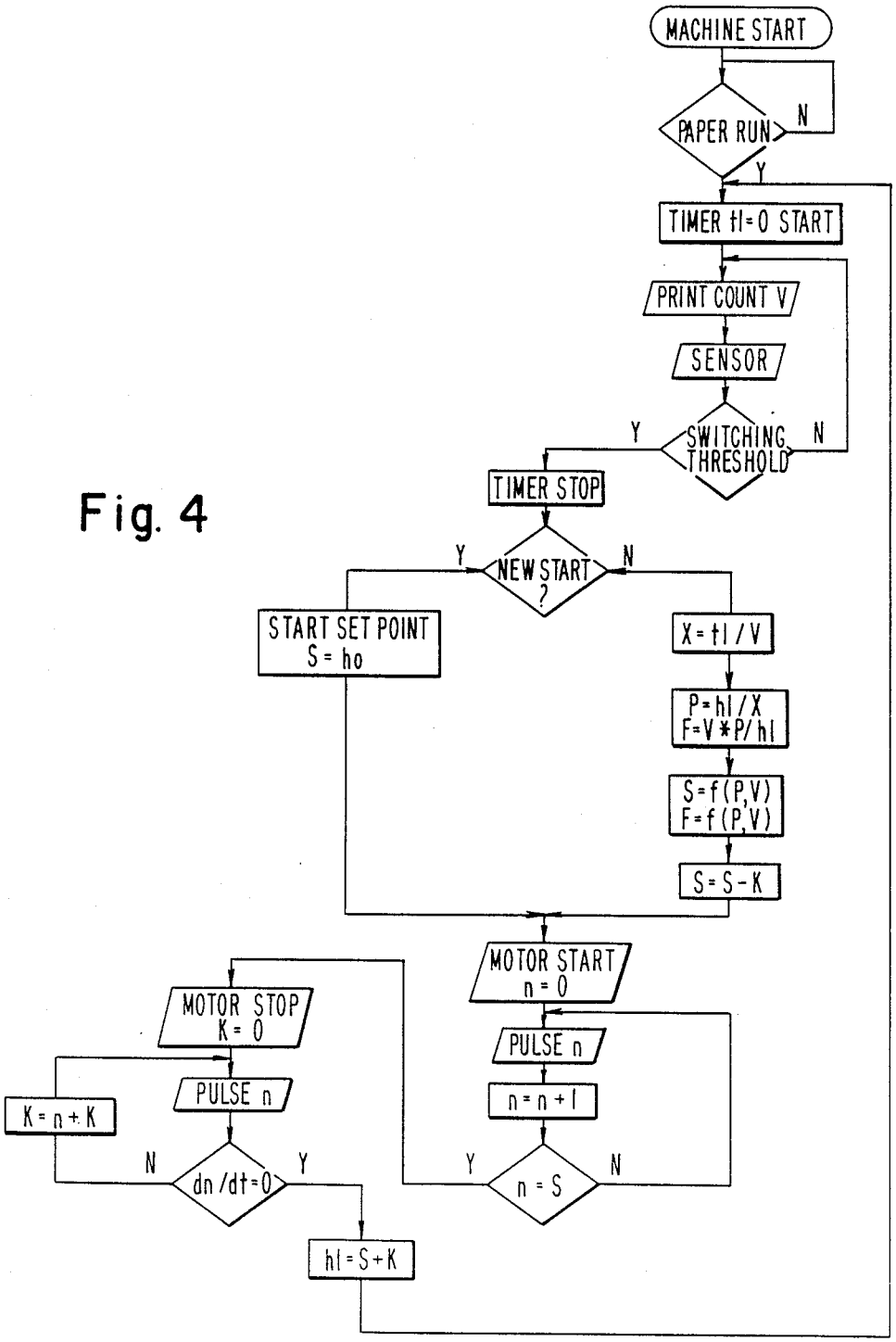
FIG. 4 is a flow chart of the flow chart forming an important part of the device according to the invention.

The control circuit 20 contains a computer and a memory in which are stored the program of the computer and empirical values for the optimal correction movement as a function of the respective sheet thickness. A flow chart is shown in FIG. 4 from which the construction of the control circuit 20 is readily apparent to a person of ordinary skill in the art.

With reference to the curve shown in solid lines in FIG. 2, a first method of operation of the device shown in FIG. 1 is described hereinafter. Before beginning the operation, the pile 4 should be in a position A which is lowered quite considerably with respect to the position of the sensor 16 (time instant t1). After the device of the invention has been switched on manually, the motor 6 is initially switched on and the pile 4 is lifted until the switch-on threshold of the sensor 16 is reached (t2). This is at the level or height H1 in FIG. 2. The instant the upper side of the pile 4 has reached the height H1, the printing press and a sheet-removing device are switched on, the sheet-removing device removing a sheet from the upper side of the pile 4 in each cycle of the printing press. After the removal of several sheets, the exact number of which is dependent upon the sheet thickness (t3), the height of the upper side of the pile 4 drops below the height H2 shown in FIG. 2, which corresponds to the switch-off threshold of the sensor 16. In this connection, the sensor 16 supplies the control circuit 20 with a signal indicating that the height of the pile 4 has fallen below the height H2. The control circuit 20 then enables the pile 4 to be lifted a distance having an empirical value corresponding preferably to a mean optimal correction movement, i.e. a mean value of the maximum possible and minimum possible, correction movements; for the embodiment represented in FIG. 2, the upper side of the pile 4 reaches the height H3 (time instant t4). To execute the afore-described lifting operation, the control circuit 20 releases the brake 14 and simultaneously switches on the motor 6. After the execution of the just-mentioned correction movement, the control circuit 20 cuts off the supply of power to the motor 6 and simultaneously activates the brake 14.

The execution of this mean correction movement is detected by an evaluation of the pulses supplied from the pulse generator 12. When the control circuit 20 has received from the pulse generator 12 a number of pulses corresponding to the aforementioned correction movement, it switches the motor 6 off. Due to the mass movement of inertia of the rotor of the motor 6 and of other components, and also due to unavoidable delays before the brake 14 becomes operative effectively, the motor 6 continues to run on slightly after the switch-off command has been given. By counting the pulses fed from the pulse generator 12 after the switch-off signal has been given by the control circuit 20, the angle of rotation through which the motor 6 has run on is detected. This value is taken into account in the future correction movements prescribed by the control circuit 20, with the result that the motor 6, respectively, is switched off just before the completion of the respective setpoint or nominal correction movement and, due to the running-on of the motor, the optimal correction movement (setpoint correction movement) is achieved with great accuracy.

After the pile 4 reaches the height H3 at the instant of time t4, while the motor 6 is at a standstill, sheets continue to be removed by the sheet-removing device, which is not switched off during the execution of the correction movements. The number of sheets removed until the height of the pile drops below the height H2 again at the time t5 is counted by evaluating the clock signals supplied from the clock generator 22.

The control circuit 20 determines the sheet thickness or paper thickness P from height H2 corresponding to the switch-off threshold, the height H4 reached after execution of the just-mentioned correction movement, and the number X of sheets removed between the time t4 and the time t5 (reaching the shut-off threshold H2), in accordance with the equation $P=(H3-H2)/X$.

The setpoint or nominal value for the next correction movement h is calculated with the aid of the table stored in the control circuit 20. If the paper thickness is 0.1 mm, for example, the correction movement should, on the basis of empirical values, be set to 1 mm, for example. This correction movement leads to the height H4 (time instant t6) in the example.

Thus, the starting frequency F of the motor 6 as a function of the press speed (measured as sheet removals per unit time) is determined by the equation $F=V\cdot P/h$.

The setpoint or nominal value S (in degrees) for the rotational angle of the motor 6 for performing the just-described correction movement to the height H4 is calculated by the control circuit 20 in accordance with the equation $S-360\cdot i\cdot h/(2\cdot r\cdot \pi)-k$, where i is the speed reduction of the gearing (the greater i is, the greater the speed reduction caused by the gear unit 8), k (in degrees) is the rotational angle of the rotor of the motor 6 which runs on after the motor has been switched off, r is the radius of the output pinion of the gear unit or transmission 8 engaging the chains carrying the table 3, h is the correction movement and $\pi=3.14159\ldots$ This setpoint or nominal value S for the rotational angle is prescribed by the control circuit 20 when the motor 6 is switched on. In the interest of simplicity, it is assumed that the pulse generator 12 produces 360 pulses for each full revolution of the shaft 10, so that each pulse corresponds to a rotational angle of 1°. The motor 6 remains switched on until the number of pulses measured by the control circuit 20 and delivered by the pulse generator 12 corresponds to the aforedescribed setpoint or nominal value S.

The angle k through which the rotor of the motor 6 runs on depends upon various operating parameters such as the weight of the pile 4, the condition of the brake 14, the ambient temperature, the mains voltage and other variables. Because these parameters generally change rather slowly, the determination of the running-on angle k in the performance of each correction movement ensures that the aforedescribed correction movement is achieved with a high degree of accuracy.

In another embodiment of the device according to the invention, the control circuit 20 is so constructed that it operates in accordance with the mode of the method represented in FIG. 3. Starting from a deeply lowered position A (t1) of the pile 4, the latter is initially lifted until the upper side of the pile 4 reaches the switch-on threshold H1 of the sensor 16 (t2). After the printing press and the sheet-removing device have been switched on manually or automatically, the height of the upper side of the pile 4 is reduced due to the removal of the sheets. After the removal (time constant t3) of a given or preset number of sheets, which, after initial switching-on, is an empirical value of $X=4$, for example, the control circuit 20 emits the signal for the pile 4 to be lifted until the upper side of the pile has again reached the position H1 (t4). The rotational angle of the motor 6 is determined during this correction movement by the height h ($h=H1-H3$) with the aid of the pulse generator 12. From the rotational angle, it is possible for the control circuit 20 to determine the actual correction movement and, with the aid of the cycle rate, the paper thickness:

$$h=(S+k)\cdot 2\cdot r\cdot \pi(i\cdot 360)$$

$$P=h/X.$$

As with the mode of the method described hereinabove with reference to FIG. 2, the control circuit 20 determines the setpoint or nominal value for the further correction movement and the correction movements following the latter, taking the paper thickness into account, and from an empirical value stored in the memory of the control device for the correction movement to be executed in accordance with this paper thickness. In the case of FIG. 3, the setpoint or nominal value is the number of cycles and sheets, respectively, after which a correction movement is executed each time. The switch-off signal for the motor is produced, respectively, based upon the signal emitted by the sensor 16 when the height H1 is exceeded.

The minimum possible presettable correction movement according to the two modes of the method described heretofore is predetermined by the hysteresis of the sensor 16, i.e. by the difference in height between the heights H1 and H2. If a sensor without hysteresis is employed, or if the hysteresis is rendered ineffective by special measures (e.g. by the fact that, for each machine printing press cycle, the sensor is lifted sufficiently from the upper side of the pile and is then returned to its original position), then arbitrarily small correction movements may be preset.

The control method may be adapted to suit the various requirements. If it is desired, for example, to keep the correction movement particularly small, the starting frequency of the motor can be increased in comparison with the mode of the method described with reference to FIG. 2. It is possible to have the paper pile follow in time with the printing press. In this connection, the correction movement may correspond to the mean paper thickness, with the height of the upper side of the paper pile varying between two limits which may lie above the height H2 and also below the height H1 in FIG. 2. In this case, it may be practical for the control circuit 20 to be so constructed that, immediately after the instant of time t5 in FIG. 2 has passed, at which the thickness of the paper has been determined, the correction movement is initially so controlled that the upper side of the paper pile is at a height $(H1+H2)/2$ or slightly in excess of the latter. Thereafter, a respective sheet is then removed, a correction movement (lifing movement) by one paper thickness is performed, the next sheet is removed and so forth. This mode of the method is associated in FIG. 2 with the curve shown in phantom after the time t5 in which the individual correction movements and sheet removals are shown schematically. If the correction movement is precisely equal to the paper thickness, and the paper thickness remains constant, then, during any length of time, neither the height H1 nor the height H2 should be exceeded in an upward or downward direction, respectively. If this should nevertheless happen it may be an indication of a change in paper thickness. In this case, it is either possible to re-establish the thickness of the paper or, if the height of the upper side of the pile had previously fallen below the height H2, the correction movement may be controlled in a manner based upon the previously established paper thickness so that the upper side of the paper pile is again at the height (H1+H2)/2, and there is then a switchover again to a correction movement equal to the mean paper thickness per machine or printing press cycle.

The starting frequency of the drive can even be raised further; however, this means that increased demands are made on the mechanical and electrical construction of the pile delivery system.

Conversely, it is possible, for example, to lower the starting frequency of the drive by selecting appropriate control commands, whereby a larger correction movement must be accepted. The advantage of a low starting frequency may lie in reducing the thermal load on the drive.

Likewise, it is possible, during the working process, to switch the control method over for different operating conditions in order to obtain optimum adaption for the respective condition.

In FIGS. 2 and 3, the course of the curve showing the change in the height or level of the upper side of the paper pile with respect to time has been greatly simplified for graphical reasons. Thus, the reduction in height, for example, between the instants of time t4 and t5, and between the instants of time t6 and t7 in FIG. 2, is not completely uniform, but rather, is step-shaped, because there is a sudden change in the height of the upper side of the paper pile if a sheet is removed whereas, between the instants of time at which sheets are removed, the height remains constant, insofar as there is no superimposed correction movement at the same time. With regard to the correction movements, for example, between the instants of time t1 and t2, between the instants of time t3 and t4 and between the instants of time t5 and t6 in FIG. 2, it is assumed that these correction movements are timed so that no sheet is removed from the pile during the correction movement; such a removal of a sheet would result in a vertical drop in height in the curve. Attention is drawn to the fact that, particularly in cases where the correction movement corresponds to a multiple of the sheet thickness, for example, a thickness of 10 sheets, it is advantageous for the correction movement to be so timed that one or more sheets are removed during the lifting movement. This then requires no excessive speeds of the correction movement and, consequently, no excessive accelerations of the sometimes quite considerable mass of the paper pile.

If, in such a case, a correction movement corresponding, for example, to 10 times the sheet thickness is to be executed and it is known that, for example, two sheets will be removed during the performance of this correction movement, the control circuit must then take this into account and, therefore, perform a correction movement corresponding to 10+2 sheet thicknesses, so that, after the execution of this correction movement, the upper side of the pile is actually 10 sheet thicknesses higher than at the start of the correction movement. Just how the sheets that have been removed are taken into account may be accomplished either before the start of the correction movement, or by having the control circuit observe during the correction movement how many clock signals are emitted by the clock generator 22 and, for each clock signal, the setpoint or nominal value of the correction movement is increased by one sheet thickness.

The invention has been described with reference to specific examples of the type that may arise when correcting the paper pile of a sheet feeder which feeds paper sheets to a printing press. However, the invention is suitable also, for example, for the sheet delivery of a printing press in which printed paper sheets are placed on a pile and the pile is lowered, so that the upper side of the pile is always approximately at the same height. It is possible also on one and the same printing press or on another sheet-processing machine to provide both a sheet feeder and a sheet delivery; in this connection, particularly in the case of a printing press, the correction movements for the sheet feeder and the sheet delivery will, in general, not be identical, particularly because a printed paper sheet is thicker than an unprinted paper sheet.

The device according to the invention affords, during the operation of the sheet-processing machine, a constant adaption of the height of the correction movement to the instantaneous paper thickness. In contrast with a simple time control, external influences such as the load, the temperature and the supply voltage as well as the condition of the brake have no adverse effect on the operation of the device according to the invention, because the actual correction movement is measured. The determination of the paper thickness is not accomplished by a single measurement of one sheet and, therefore, has limited susceptibility to malfunctions. The magnitude of the correction movement may be chosen at random, e.g. greater or smaller than (H2−H1), and the invention can be used even if the sensor 16 has no hysteresis.

Furthermore, it is possible to monitor the operation of the motor and of the brake by evaluating the signals from the pulse generator and, if necessary, produce a warning signal.

Insofar as the device according to the invention determines the paper thickness or the sheet thickness, this variable may be indicated or displayed and/or supplied to a control device of the sheet-processing machine which can use this variable, if necessary, for control or adjustment purposes.

The foregoing is a description corresponding in substance to German Application No. P 36 31 456.0, dated Sept. 16, 1986, the International priority of which is being claimed for the instant application, and which is hereby made part of this application. Any material discrepancies between the foregoing specification and the aforementioned corresponding German application are to be resolved in favor of the latter.

We claim:

1. A device for controlling a pile-lifting device of a sheet-processing machine having a drive for performing correction movements in order to keep the upper side of the pile within a range of heights, a device for scanning the position of an upper side of the pile so as to determine whether the upper side of the pile has reached a predetermined height or not, and a control device for controlling the correction movements in accordance with the result of the scanning of the position of the upper side of the pile, comprising means for determining a quantity dependent upon the correction movement, and a memory wherein setpoint values for the correction movement as a function of sheet thickness are storable, having means for enabling, in accordance with the sheet thickness, a performance of a correction movement having a magnitude corresponding to a value assigned to the sheet thickness and contained in said memory.

2. Device according to claim 1, including means for producing information regarding operating speed of the machine.

3. Device according to claim 1, wherein the control device is of such construction that it enables a performance of a respective correction movement having a magnitude greater than one sheet thickness.

4. Device according to claim 1, wherein the control device is of such construction that it enables a performance of a respective correction movement having a magnitude corresponding to a single sheet thickness.

5. Device according to claim 1, wherein the control device is of such construction that it enables a performance of a respective correction movement having a magnitude smaller than one sheet thickness.

6. Device according to claim 1, wherein the control device is of such concentration that it enables a performance of a correction movement which is continuous.

7. Device according to claim 1, wherein the control device is so constructed that, depending upon the determination of a value, the control device switches the correction movement over.

8. Device according to claim 1, including means for producing information on operating speed of the machine, means for producing information on the magnitude of an executed correction movement, and means for determining sheet thickness from the information from both of said information producing means.

9. Device according to claim 1, wherein the control device is constructed so that a starting frequency of the drive is within a prescribed range.

10. Device according to claim 1, wherein the control device is constructed so as to adjust a value of at least one of the correction movement and a starting frequency of the drive, depending upon a mean quantity of paper to be delivered per unit time.

11. Device according to claim 1, including means for detecting movement continued by the pile-lifting device at the end of a correction movement after the drive has been switched off and means for determining an actually performed correction movement from a continued movement detected by said detecting means.

12. Device according to claim 1, wherein the control device comprises an arrangement for varying the speed of the correction movement.

13. Method of operating a device for controlling a pile-lifting device of a sheet-processing machine by performing a correction movement in order to keep an upper side of a pile within a range of heights, scanning the position of the upper side of the pile so as to determine whether the upper side of the pile has reached a predetermined height or not, and controlling the correction movement in accordance with the result of the scanning of the position of the upper side of the pile, which includes determining a quantity dependent upon the correction movement, storing in a memory setpoint values for the correction movement as a function of sheet thickness and, depending upon sheet thickness, enabling a performance of a correction movement having a magnitude corresponding to a value assigned to the sheet thickness and stored in the memory.

14. Method according to claim 13 which includes producing information regarding operating speed of the machine.

15. Method according to claim 13 wherein the corrective movement has a magnitude ranging in value from less than a sheet thickness to greater than a sheet thickness.

16. Method according to claim 13 which includes performing the correction movement continuously.

17. Method according to claim 13 which includes switching the correction movement over, depending upon the determination of a value.

18. Method according to claim 13, which includes producing information on operating speed of the machine, producing information on the magnitude of an executed correction movement, and determining sheet thickness from both of the produced informations.

19. Method according to claim 13, wherein a starting frequency of the drive is within a prescribed range.

20. Method according to claim 13, which includes, depending upon a mean quantity of paper to be delivered per unit time, adjusting a value of at least one of the correction movement and a starting frequency of the drive.

21. Method according to claim 13, which includes detecting a movement continued by the pile-lifting device at the end of a correction movement after the drive has been switched off, and determining an actually performed correction movement from the detected continued movement.

22. Method according to claim 13 which includes varying the speed of the correction movement.

* * * * *